US005865188A

United States Patent [19]

Marquez

[11] Patent Number: 5,865,188

[45] Date of Patent: Feb. 2, 1999

[54] BRUSH FOR STRAIGHTENING HAIR

[75] Inventor: Diane J. Marquez, Huntington Beach, Calif.

[73] Assignee: West Coast Hair Systems, LLC, Huntington Beach, Calif.

[21] Appl. No.: 755,386

[22] Filed: Nov. 22, 1996

[51] Int. Cl.[6] ..... A45D 24/06

[52] U.S. Cl. ..... 132/132; 132/138

[58] Field of Search ..... 132/132, 129, 132/133, 134, 138, 120, 139; 15/106, 110, 104.5

[56] References Cited

U.S. PATENT DOCUMENTS

| | | | |
|---|---|---|---|
| 71,036 | 11/1867 | Merritt . | |
| 756,842 | 4/1904 | Emmons . | |
| 877,960 | 4/1908 | Stafford . | |
| 1,206,679 | 11/1916 | Cummings . | |
| 1,853,828 | 4/1932 | Mani | 132/132 |
| 1,905,399 | 4/1933 | Wagner . | |
| 2,231,554 | 2/1941 | Thomas . | |
| 2,419,777 | 4/1947 | Howe . | |
| 2,528,291 | 10/1950 | Winston | 132/129 |
| 2,601,858 | 7/1952 | Ackerman | 132/133 |
| 2,683,274 | 7/1954 | Kappes | 15/106 |
| 2,818,061 | 12/1957 | Birch | 15/110 |
| 3,105,501 | 10/1963 | Scotti . | |
| 3,146,478 | 9/1964 | Rosenthal | 15/110 |
| 3,450,140 | 6/1969 | Vail . | |
| 3,603,323 | 9/1971 | Avella | 132/131 |
| 3,608,565 | 9/1971 | Ensign . | |
| 3,894,548 | 7/1975 | Suvino . | |
| 4,671,302 | 6/1987 | Hill . | |
| 4,830,030 | 5/1989 | Busch et al. | 132/212 |
| 5,007,442 | 4/1991 | Hirzel | 132/120 |
| 5,228,465 | 7/1993 | Hill | 132/212 |
| 5,460,191 | 10/1995 | Bonomelli | 132/271 |

FOREIGN PATENT DOCUMENTS

| | | | |
|---|---|---|---|
| 102144 | 11/1923 | Switzerland | 15/104.5 |
| 20354 | 10/1893 | United Kingdom | 132/132 |
| 262689 | 12/1926 | United Kingdom | 132/120 |

*Primary Examiner*—Todd E. Manahan
*Attorney, Agent, or Firm*—Christie, Parker & Hale, LLP

[57] ABSTRACT

A hair brush useful for temporarily straightening curly or wavy hair is provided having first and second brush heads hinged to one another at their handles. The first and second brush heads are biased away from one another so that the hair brush is normally in an open position. The hair brush is used by grasping the handles and squeezing the heads together to grip a portion of a person's hair. The brush is moved through the hair to hold the hair straight so that it can be blow dried.

15 Claims, 3 Drawing Sheets

BRUSH FOR STRAIGHTENING HAIR

FIELD OF THE INVENTION

This invention is directed to a hair brush that can be used with a blow dryer to temporarily straighten curly or wavy hair.

BACKGROUND OF THE INVENTION

Various methods for temporarily straightening curly or wavy hair are well known. One method often employed by professional hair stylists includes the use of a brush to slowly pull wet hair straight while blow drying the hair straight. Typically a hair stylist will do this by first grasping a portion of the customer's hair near the scalp with a typical hair styling brush and slowly pulling the hair through the brush while simultaneously blow drying the hair. The hair is grasped by first placing the brush's bristles in the hair and then giving the brush a slight twist in order to secure the hair within the bristles. The process is repeated over various portions of the customer's hair until the desired straightening effect has been achieved.

Such a technique has certain drawbacks. First, while a professional hair stylist's technique of grasping a customer's hair with a simple twist of a styling brush can look effortless, in practice it is a fairly difficult skill for a typical person to master. Often the person trying to grasp another's hair by such a technique will grasp the hair too securely in the brush and pull the hair unnecessarily. Furthermore, while the technique is difficult to master on another's hair, it can be almost impossible to do on one's own hair. Even a professional hair stylist can have difficulty using this technique to straighten his or her own hair.

Another drawback to such a technique is that a portion of the hair must remain grasped by the twisted hair brush for the method to be effective. Consequently, the inch or two of hair most distal from the scalp can be difficult to straighten by this technique.

SUMMARY OF THE INVENTION

An improved hair brush useful for straightening hair is provided by the present invention. According to the invention, a pair of brush heads are provided, each having a plurality of bristles. The two brush heads are joined to one another at their handles with the bristles facing one another by a biased hinge such that the two brush heads are biased away from one another. A person who wishes to straighten another's hair or even his or her own hair can use the hair brush to grasp the hair to be straightened by simply squeezing the hinged handles together in order to capture the hair between the facing brush heads. A portion of wet hair is first grasped near the scalp and then slowly pulled away from the scalp while the hair is blow dried. The strength of the grip in the person's hair can be easily adjusted by the pressure placed on the handles. Consequently, there is no unnecessary pulling of the hair. The process is repeated with different portions of hair until the desired straightening effect has been achieved.

In order to provide optimal gripping ability while permitting the brush to be comfortably moved through the person's hair, the first brush head is provided with a plurality of bristles that are provided in a grid configuration with each bristle spaced apart from the other bristles. These bristles are fairly rigid and are about ¾ inches long. The second brush head, rather than including rigid individually spaced bristles, preferably includes shorter, more flexible bristles that are more densely spaced. Preferably, these bristles are about ½ to ¾ inches in length and are in tufts that are arranged in a grid pattern on the lower brush head.

This combination of bristles on the two brush heads provides excellent gripping ability with hair. Yet, the hair brush can be easily moved through the hair without unnecessary discomfort. Furthermore, the hair brush can be moved almost the entire length of the hair so that there will not be an end portion of the hair that has not been straightened.

BRIEF DESCRIPTION OF THE DRAWINGS

Other features, aspects and advantages of the present invention will be more fully understood when considered with respect to the following detailed description, appended claims, and accompanying drawings where:

DETAILED DESCRIPTION OF THE INVENTION

Figure 1:
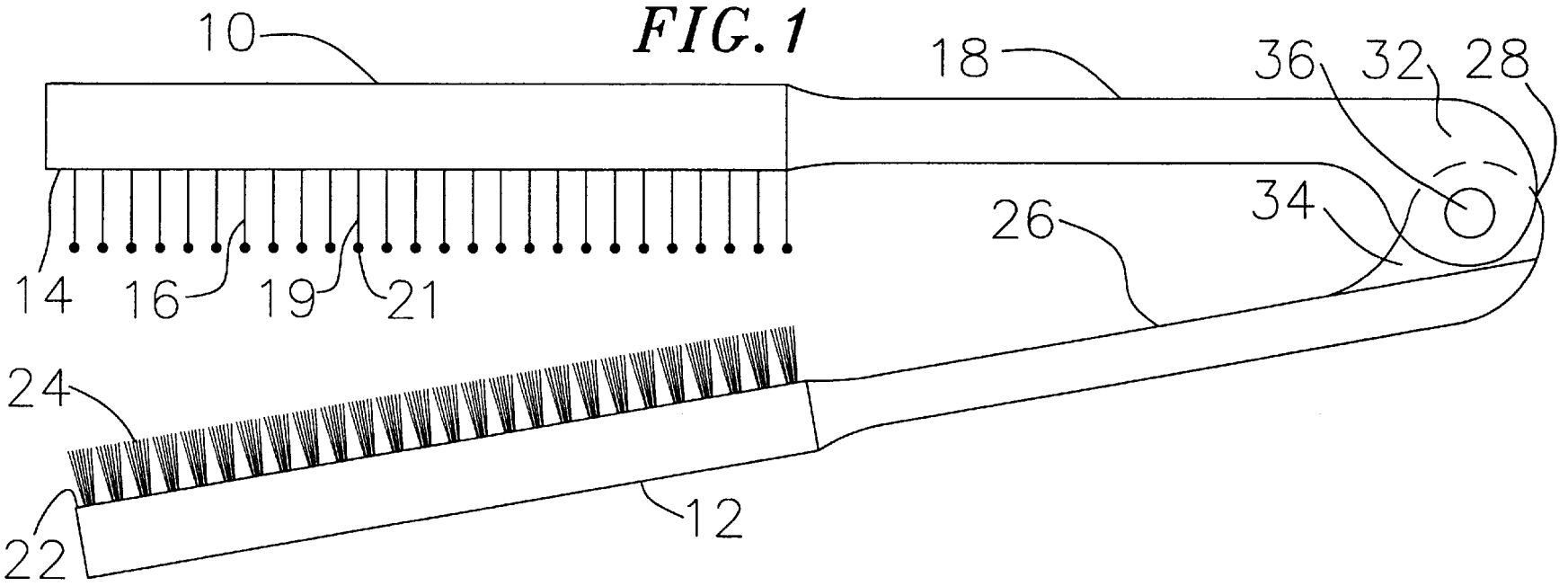
FIG. 1 is an elevation view of a hair brush of the present invention in an open position.

Referring to FIGS. 1 through 4, first and second brush heads 10, 12 are provided. The first brush head includes a generally planar face 14 having a plurality of individual bristles 16 extending from it in a direction generally perpendicular to the face. A first handle 18 is provided extending from the first brush head in a direction generally parallel to the plane of the face. In effect, the first brush head is configured similar to a typical hair brush.

Each of the bristles of the first brush head preferably comprises a fairly rigid shaft 19 with a small bulb 21 at its end. Such a bristle design is often used for comfort to prevent the shaft from irritating the scalp and for preventing the bristles from wearing out. The shaft can be made of various materials such as lengths of metal that are flexibly mounted to the face of the brush head. The shafts can also be made of a more flexible plastic material. The shafts should be rigid enough to to be able to be moved through the hair without losing contact with the hair, yet flexible enough to slide through the hair comfortably. The preferred bristles are generally about ¾ inch long and provided in a grid arrangement with about 25 to 36 individual bristles per square inch.

The second brush head similarly includes a generally planar face 22 with a plurality of bristles 24 extending from it in a direction generally perpendicular to the face. Like the first brush head, a handle 26 is provided extending from the face in a direction generally parallel to the plane of the face. The second brush head is also similar to a conventional hair brush.

Unlike the bristles of the first brush head, the bristles of the second brush head are more densely packed. Preferably these bristles are also shorter and of a more flexible material than the bristles of the first brush head. The bristles of the second head are preferably about ½ to ¾ inches in length. In the preferred embodiment, the bristles of the second brush head are provided in tufts 27 arranged in a grid on the face of the brush head. Preferably, each tuft includes about 20 bristles. The tufts are preferably spaced with about 16 tufts per square inch.

The first and second brush heads are hinged to one another at their handles by a hinge 28 formed by the handles. A first pair of hinge tabs 32 on the handle of the first brush head interlock with a second pair of hinge tabs 34 on the second brush head. A pin 36 is inserted through apertures 38 provided in each of the hinge tabs to pivotally join the two brush portions together.

Figure 5:
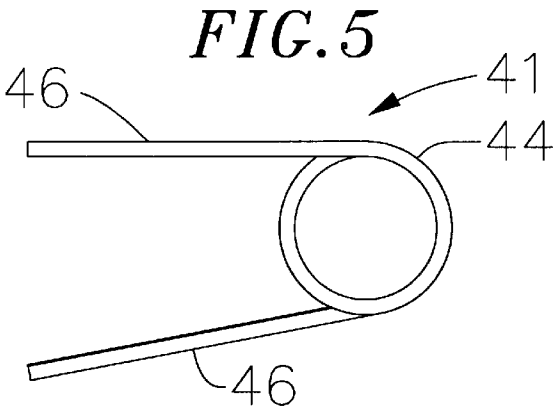
FIG. 5 is an illustration of a spring used for biasing the two brush heads away from one another.

The brush heads are biased away from one another in an open position by a spring 41 such as is illustrated in FIG. 5. According to this embodiment, the spring comprises a coil 44 with a pair of arms 46 extending tangentially from the coil in a configuration such as the springs commonly used for safety pins or clothes pins. Referring back to FIGS. 3 and 4, each pair of hinge tabs defines a slot 42 for receiving the arm of the spring. The spring is held in place by the pin which in addition to being inserted through the apertures of the hinge tabs is also inserted through the hole defined by the coil.

Figure 2:
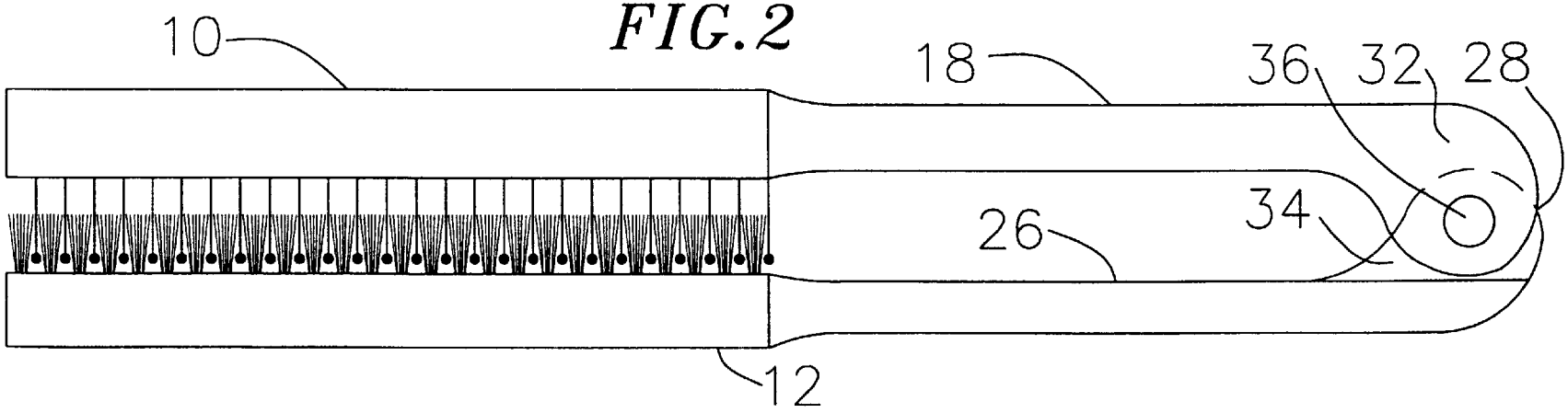
FIG. 2 is an elevation view of the hair brush of FIG. 1 in a closed position.
Figure 3:
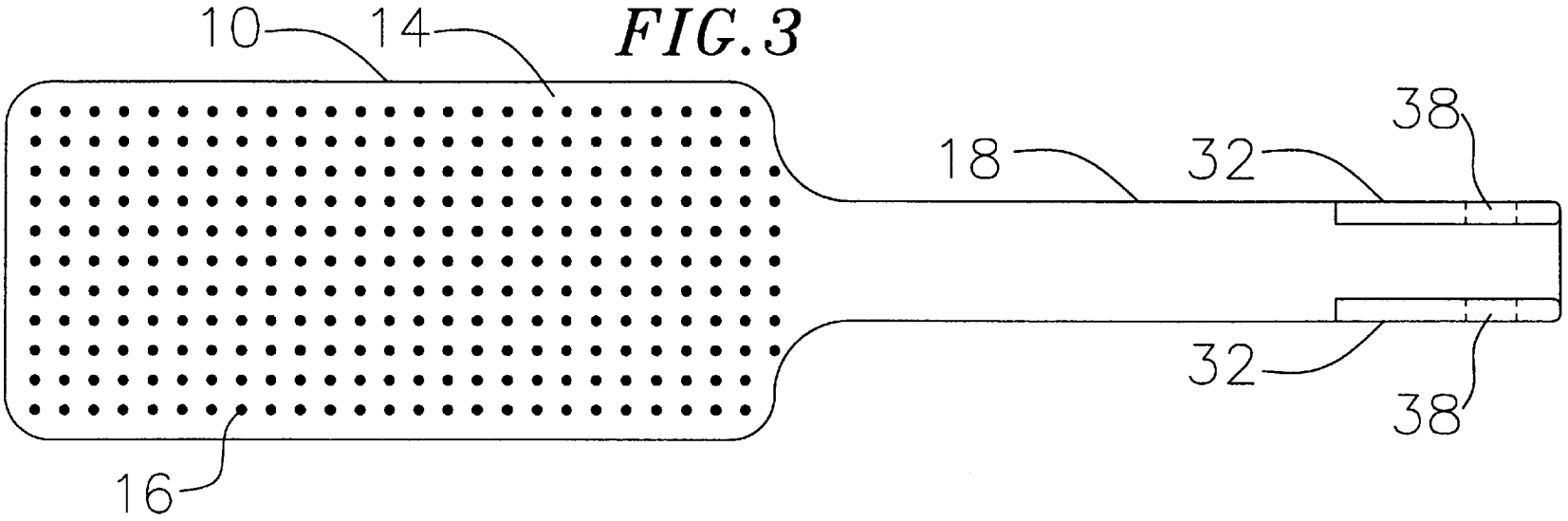
FIGS. 3 and 4 are plan views of the upper and lower brush heads, respectively, of the hair brush of FIGS. 1 and 2.
Figure 4:
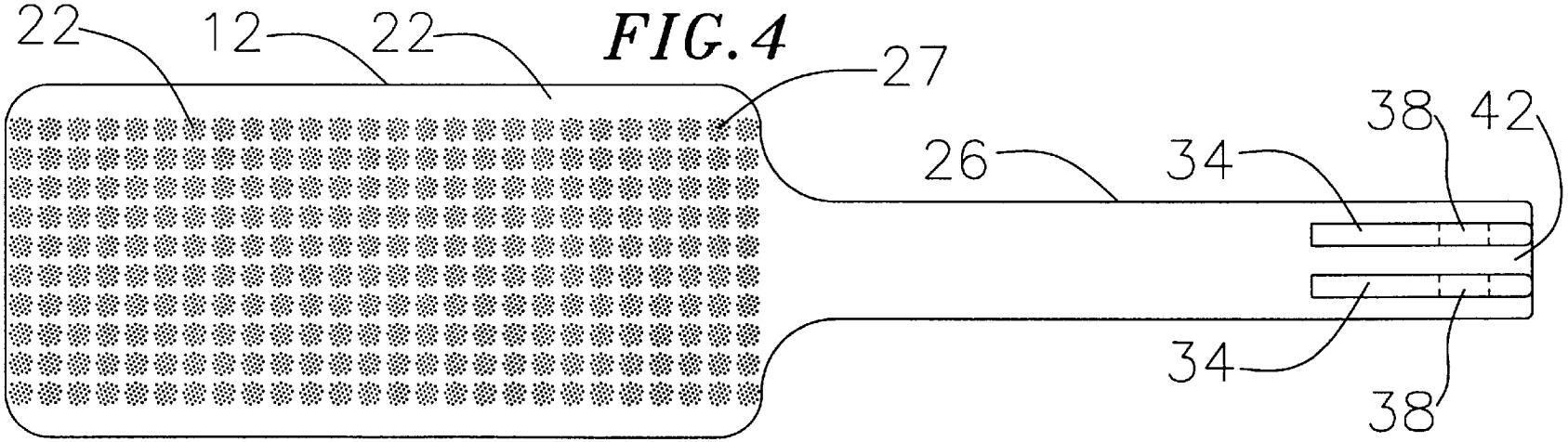

As is best illustrated in FIGS. 1 and 2, when the first and second brush portions are assembled to one another, a two-headed hair brush is provided that is normally biased in an open position with the two heads apart from one another as illustrated in FIG. 1. By lightly grasping the handles and squeezing them together, the bristles on the first and second brush portions can be pressed toward one another to grasp a portion of hair. Using this brush, a person can easily straighten another person's hair or even his or her own hair by merely wetting the hair, grasping a portion of hair near the scalp with the brush as described above, and slowly pulling the brush through the hair while simultaneously holding the hair straight and blow drying the hair dry. This process can be repeated over various sections of the person's hair until the desired result has been achieved.

Advantages of the present invention include its ease of use. While professional hair stylists can easily grasp a person's hair with a conventional brush using techniques described above, virtually anyone can achieve a professional result using the hair brush of the present invention. Furthermore, even a professional hair stylist may have difficulty using a conventional brush technique with either hand. In contrast, the hair brush of the present invention can be simply used with either hand without any special dexterity. A professional hair stylist can also use the hair brush of the present invention on his or her own hair. In the past, even a professional hair stylist might have difficulty in such an endeavor. Consequently, the present invention is not only useful for amateurs, it is also useful for professional hair stylists. Moreover, the hair can be straightened right up to the ends with the hair brush of the present invention. Using a conventional brush, there is generally a portion at the end of the hair that is difficult to straighten.

Figure 6:
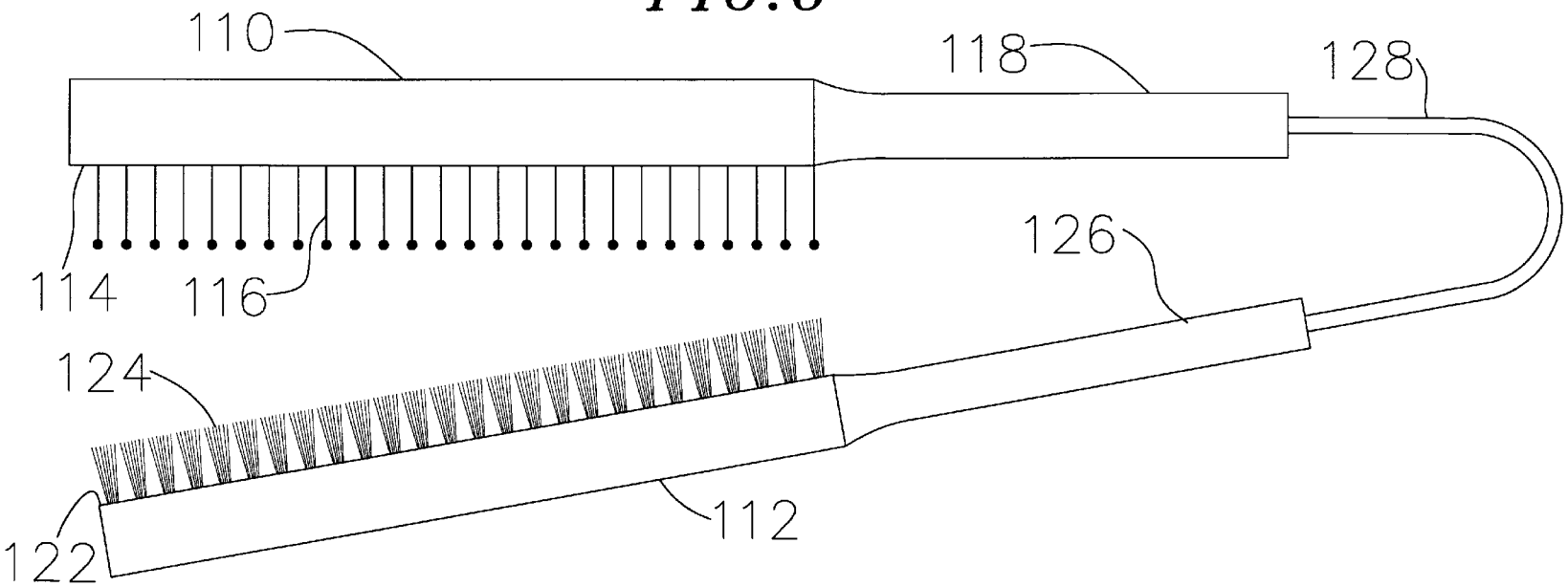
FIG. 6 is an elevation view of an alternate embodiment of the present invention.

An alternate embodiment of the present invention is illustrated in FIG. 6. As in the previous embodiment, the brush includes first and second brush heads 110, 112. A first face 114 is provided with individually spaced bristles 116 and a handle 118.

A second face 122 is provided with shorter, more closely spaced tufted bristles 124 and a handle 126. The handles of the two brush portions are joined to one another by a biased hinge 128. However, rather than a coil spring as provided above, the spring in this embodiment is merely a resilient and springy length of metal ribbon provided in a U-configuration. According to this embodiment, the ribbon of metal is fastened or otherwise adhered to the handles, or can even be molded within the handles of the first and second brush heads. Rather than a metal spring, a similar configuration can be used with a durable, resilient plastic material and the brush heads can even be molded from plastic in a single piece with an integral spring section. As with the previous embodiment, this brush can easily be grasped in one hand and the first and second brush heads can be pressed toward one another in order to grasp a person's hair.

Having described the preferred embodiment of the present invention, it is apparent that several modifications may be made while keeping within the spirit and scope of the following claims.

What is claimed is:

1. A hair brush for use in straightening a lock of a person's scalp hair comprising:

a first brush head of a size useful for brushing scalp hair having a first plurality of flexible bristles in a first configuration extending from it;

a second brush head of a size useful for brushing scalp hair having a second plurality of flexible bristles in a second configuration different from the first configuration extending from it;

a hinge for connecting to one another the first and second brush heads with the first and second plurality of bristles generally directed toward one another such that when the hinge is in a closed position, the first plurality of bristles and the second plurality of bristles overlap with one another to grasp the lock of hair without curling it; and means for biasing the first and second brush heads away from one another to release the lock of hair.

2. The hair brush of claim 1 wherein the first configuration of bristles are individual bristles provided in a grid with the individual bristles spaced from one another.

3. The hair brush of claim 2 wherein the second configuration of bristles are spaced closer to one another than the first plurality of bristles.

4. The hair brush of claim 3 wherein the second configuration of bristles are provided in tufts arranged in a grid pattern.

5. The brush of claim 3 wherein the first configuration of bristles is longer than the second configuration of bristles and the second configuration of bristles is more flexible than the first configuration of bristles.

6. A hair brush for use in straightening a lock of a person's scalp hair comprising:

a first brush head of a size useful for brushing scalp hair including a first plurality of flexible bristles;

a first handle having first and second ends, the first end being attached to the first brush head;

a second brush head of a size useful for brushing scalp hair having a second plurality of flexible bristles, the second plurality of bristles being more flexible than the first plurality of bristles;

a second handle having first and second ends, the first end being attached to the second brush head; and a biased hinge joining the second ends of the first and second handles to one another such that in a closed position the first and second plurality of bristles overlap with one another to grasp the lock of hair without curling it.

7. The hair brush of claim 6 wherein the first plurality of bristles comprises individual bristles spaced apart from one another.

8. The hair brush of claim 7 wherein the second plurality of bristles comprises a plurality of tufts of bristles.

9. The hair brush of claim 6 wherein the first plurality of bristles is longer than the second plurality of bristles.

10. The hair brush of claim 6 wherein the biased hinge comprises a spring integral to the first and second handles.

11. The hair brush of claim 6 wherein the biased hinge comprises a coil spring and a pin hingedly joining the second ends of the first and second handles.

12. A brush for use in straightening a lock of a person's scalp hair comprising:

a first head of a size useful for brushing scalp hair with a plurality of flexible individual bristles spaced apart from one another;

a second head of a size useful for brushing scalp hair having a plurality of flexible closely spaced bristles shorter and more flexible than the individual bristles;

a hinge for joining the first and second heads to one another in a pivotal arrangement such that when the hinge is in a closed position, the individual bristles of the first head overlap with the closely spaced bristles of the second head to grasp the lock of hair without curling it; and a spring for biasing the first and second heads away from one another.

13. The hair brush of claim 12 wherein the hinge and spring are integral to one another.

14. The hair brush of claim 12 wherein the spring comprises a coil spring.

15. A hair brush for use in straightening a lock of a person's scalp hair comprising:

a first brush head of a size useful for brushing scalp hair having a first plurality of flexible bristles extending from it;

a second brush head of a size useful for brushing scalp hair having a second plurality of flexible bristles extending from it;

a hinge for connecting to one another the first and second brush heads with the first and second plurality of bristles generally directed toward one another such that when the hinge is in a closed position, the first plurality of bristles and the second plurality of bristles overlap with one another to grasp the lock of hair without curling it; and means for biasing the first and second brush heads away from one another to release the lock of hair.

* * * * *